US006405879B1

(12) United States Patent
Fox

(10) Patent No.: US 6,405,879 B1
(45) Date of Patent: Jun. 18, 2002

(54) VERTICAL CARD DISPLAY

(75) Inventor: Andrew C. Fox, 11317 Acuff La., Lenexa, KS (US) 66215

(73) Assignee: Andrew C. Fox, Lenexa, KS (US)

( * ) Notice: Subject to any disclaimer, the term of this patent is extended or adjusted under 35 U.S.C. 154(b) by 0 days.

(21) Appl. No.: 09/503,223

(22) Filed: Feb. 11, 2000

(51) Int. Cl.[7] ..... B42F 1/00
(52) U.S. Cl. ..... 211/50; 211/113
(58) Field of Search ..... 211/113, 50, 55, 211/56, 58, 118, 163, 167, 189; 206/806, 425; 312/183, 184; D19/75; D6/396, 449, 455, 457, 460; 40/124, 124.2, 124.4, 617, 611, 360, 391

(56) References Cited

U.S. PATENT DOCUMENTS

| | | | | | |
|---|---|---|---|---|---|
| 835,178 | A | * | 11/1906 | Clare | |
| 838,294 | A | * | 12/1906 | Zeiner | |
| 1,677,318 | A | * | 7/1928 | Alexander | D6/1 |
| 2,226,976 | A | * | 12/1940 | Leaming | |
| 2,651,421 | A | * | 9/1953 | King | 211/55 |
| 2,808,941 | A | * | 10/1957 | Foster | 211/13.1 |
| 2,959,879 | A | * | 11/1960 | Mazur | |
| D222,307 | S | * | 10/1971 | Dogliotti | D6/1 |
| 4,105,057 | A | * | 8/1978 | Baumann et al. | 40/124.4 |
| 4,392,316 | A | * | 7/1983 | Thomas | 40/617 |
| 4,419,837 | A | * | 12/1983 | Meeker | 40/359 |
| 4,548,324 | A | * | 10/1985 | Mackey, Jr. | 211/58 |
| 4,571,867 | A | * | 2/1986 | Williams | 40/405 |
| 4,779,996 | A | * | 10/1988 | Sengewald | 206/806 |
| 4,920,673 | A | * | 5/1990 | Mitsuyama | 40/405 |
| 4,993,560 | A | * | 2/1991 | Jaffe | 211/45 |
| 5,050,747 | A | * | 9/1991 | Krautsack | 211/50 |
| 5,054,624 | A | * | 10/1991 | Camp | 211/13.1 |
| 5,096,070 | A | * | 3/1992 | Jaynes | 211/71 |
| 5,096,073 | A | * | 3/1992 | O'Brien | 211/163 |
| 5,097,961 | A | * | 3/1992 | Patino et al. | 211/10 |
| 5,347,734 | A | * | 9/1994 | Howell et al. | 40/506 |
| 5,377,833 | A | * | 1/1995 | Ranger | 206/430 |
| 5,386,916 | A | * | 2/1995 | Valiulis | 211/113 |
| 5,405,022 | A | * | 4/1995 | Rissley | 211/59.1 |
| 5,421,665 | A | * | 6/1995 | Strassberg | 40/124.2 |
| 5,487,617 | A | * | 1/1996 | Cole et al. | 211/113 |
| 5,683,002 | A | * | 11/1997 | Rayside | 211/113 |
| 5,732,833 | A | * | 3/1998 | Alvarado et al. | 211/59.1 |
| 5,743,403 | A | * | 4/1998 | Crysdale | 206/482 |
| 6,126,021 | A | * | 10/2000 | Wilhite | 211/119.004 |

* cited by examiner

*Primary Examiner*—Daniel P. Stodola
*Assistant Examiner*—Jennifer E. Novosad
(74) *Attorney, Agent, or Firm*—Lathrop & Gage LC

(57) ABSTRACT

An apparatus for holding and displaying cards including a plurality of vertical panels having at least one pair of opposed slits defining a pocket for holding the cards. Each slit has an upper end, a lower end and an aperture at either the upper end or lower end. The aperture is operatively configured to allow the pocket to expand to thereby accept a greater number of cards. The apparatus further comprises at least one support having a nodule for each vertical panel. Each nodule is configured to be coupled with the aperture of each vertical panel such that the plurality of vertical panels are interconnected by the support.

3 Claims, 2 Drawing Sheets

VERTICAL CARD DISPLAY

BACKGROUND OF THE INVENTION

1. Field of the Invention

This invention relates generally to an apparatus for housing and displaying cards, and more particularly to a plurality of vertical panels that are operably configured to be mateable and display the cards housed therein in an aesthetically appealing manner.

2. Description of the Related Art

Conventially, retail stores that sell greeting cards are provided with counters having shelves which ascend rearwardly to display greeting cards. Given this configuration, these counters occupy significant store space and are often placed in a remote corner or aisle away from the casual shopper. It is desirable to display greeting cards in locations where a casual shopper may happen upon a display to remind the shopper of any greeting-card needs. Furthermore it is desirable to maximize the use of a stores space to sell product.

Some display stands have been created to resolve these concerns. Free-standing and revolving display stands have been developed that can be placed at check-out counters to display the cards. While these stands take up considerably less space, another concern for displaying greeting cards is the expense for installing such shelving. Smaller retail stores may not find it profitable to install shelving specifically for selling greeting cards. Thus, greeting-card distributors may find it useful to ship a display for the cards that it expects to sell. This display must be inexpensive to manufacture and ship, and must display the greeting cards in an aestheticaly pleasing manner.

Thus a need exists for an inexpensive greeting-card display apparatus that is easily mountable at locations where the casual consumer may encounter the display.

SUMMARY OF THE INVENTION

It is an object of the invention to provide an apparatus useful for displaying two- or three-dimensional materials.

It is a further object of the invention to provide a display apparatus that can either be mounted on a wall or other vertical surface, or which can be mated with additional display apparatuses to create a three-dimensional, free-standing display apparatus.

It is further an object of the present invention to provide an inexpensive and easily assembled greeting card display.

It is still further an object of the present invention to provide a greeting card display that is easily shipped and occupies minimal store space upon assembly.

These objects are accomplished in accordance with the preferred embodiment of the present invention by providing an apparatus for holding and displaying cards. The apparatus comprises a plurality of vertical panels, with at least one of the vertical panels having at least one pair of opposed slits defining a pocket for holding the cards. Each slit has an upper end, a lower end and an aperture at either the upper end or lower end of each slit. The aperture is operatively configured to allow the pocket to expand to thereby accept a greater number of cards. The plurality of panels are interconnected by at least one support having a nodule for each vertical panel. Each nodule is operatively configured to be coupled with at least one aperture of each vertical panel such that the plurality of vertical panels are interconnected by the at least one support.

In an alternative embodiment, these objects are accomplished by providing a card-display apparatus for mounting to a substantially vertical surface for holding and displaying cards. The apparatus comprising a substantially vertical panel having at least two pair of opposed slits defining a pocket for holding the cards, each slit of the at least two pair of slits having an upper end, a lower end and an aperture at at least one of the upper end and lower end of each slit. The aperture is operatively configured to allow the pocket to expand to thereby enable the pocket to accept a greater number of cards. The at least two pair of slits are vertically aligned.

BRIEF DESCRIPTION OF THE DRAWINGS

The preferred embodiment of the present invention is further described in connection with the accompanying drawings, in which.

DETAILED DESCRIPTION OF THE INVENTION

Figure 1:
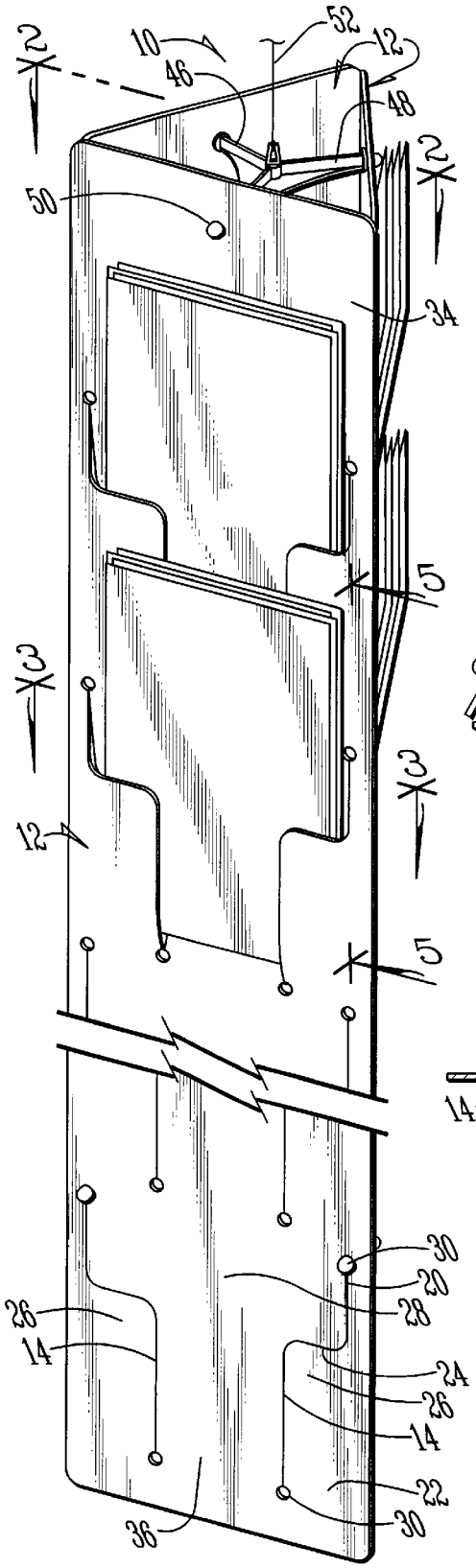
Fig. 1 is a perspective view of the card display of the present invention holding several cards in several pair of slits.

Reference will now be made in detail to the preferred embodiment of the present invention, an example of which is illustrated in the accompanying figures. Whenever possible, the same reference numbers will be used throughout the description and figures to refer to the same or like parts.

Referring now to the drawings, an apparatus for holding and displaying cards in accordance with the present invention is indicated generally at 10. The apparatus comprises a plurality of vertical panels 12 having pairs of opposed slits 14 defining a pockets 16 for holding cards and at least one support 18 for interconnecting the plurality of vertical panels.

In a preferred embodiment, the card display includes three vertical panel, each generally indicated at 12. Each panel 12 is constructed of a thin, sturdy synthetic resin sheet having pairs of slits 14 disposed vertically in several rows for insertably holding a card, and particularly a greeting card. Preferably, the sheet is made transparent to enable the cards to be distinguished as to the kinds and the patterns of the cards as they are housed in the card-display apparatus.

As shown in FIG. 1, each slit 14 has a top end 20 and a bottom end 22 and each pair of slits are spaced from each other at the top ends of the respective slits by a distance somewhat larger than the width of the card. The slits 14 further extend from the top end 20 to the bottom end 22 and each includes an inward step 24 to approach the other preferably at approximately the midportion of the slit. It is to be understood that the slit 14 could slant inwardly toward each other from the top end to the bottom end, without departing from the scope of the present invention.

Figure 5:
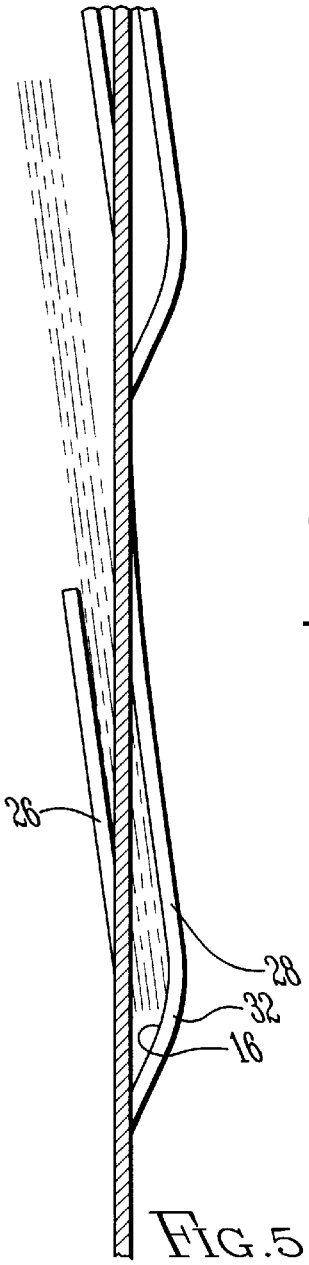
FIG. 5 is a cross-sectional view taken along line 5—5 of FIG. 1 showing the pocket of the present invention holding several cards.

Each pair of slits 14 as formed as above-mentioned thereby define a pocket 16 having a card supporting portion 26 at the inward step 24 and a base 28 at the interior angle side of the slits 14, whereby the card inserted from above into the slits is held at both sides in a sandwiching manner in the pocket 16 between the base of the vertical panel and the card-supporting portion. The card-supporting portion 26, as shown in FIGS. 1 and 5, is pulled outwardly frontwise of the card 12 after the card is inserted into each pair of slits 14, thereby securing the card in the apparatus of the present invention.

In order to facilitate the acceptance of the cards and permit the insertion of multiple cards, the top and bottom ends 20, 22, respectively, of each slit 14 is formed with a relief 30. As shown in FIG. 5, the relief is preferably formed as an aperture, which permits the card-supporting portions 26 of each slit to move frontwise of the display apparatus. The aperture 30 may be sized to accommodate a particular number of cards.

The vertical interval between the upper end 20 and the lower end 22 of each slit for each pair of slits is preferably set smaller than the longitudinal length of the card. As such, when the card is inserted into a pair of slits 14 until the card abuts at a lower edge 32 of the pair of slits, the upper edge of the card projects upwardly from the upper end 20 of each pair of slits as shown in FIG. 1. This enables the card to be easily viewed and slipped in or out of the card display apparatus 10.

The vertical interval between respective pairs of slits 14 is set such that a standard size card slightly overlap the pair of slits immediately above the pair of slits in which the card is mounted. This provides for a particularly aesthetically pleasing display enabling a plurality of cards to be arranged vertically in an orderly fashion.

It is to be understood that the slits 14 provided on each panel 12 may be of different heights at the upper ends without departing from the scope of the present invention. This enables the greeting cards to be inserted firstly at one end into the higher slit end (not shown) of one of the pair of slits 14 and then at the other end into the lower slit thereby enabling smooth insertion of the cards.

Figure 2:
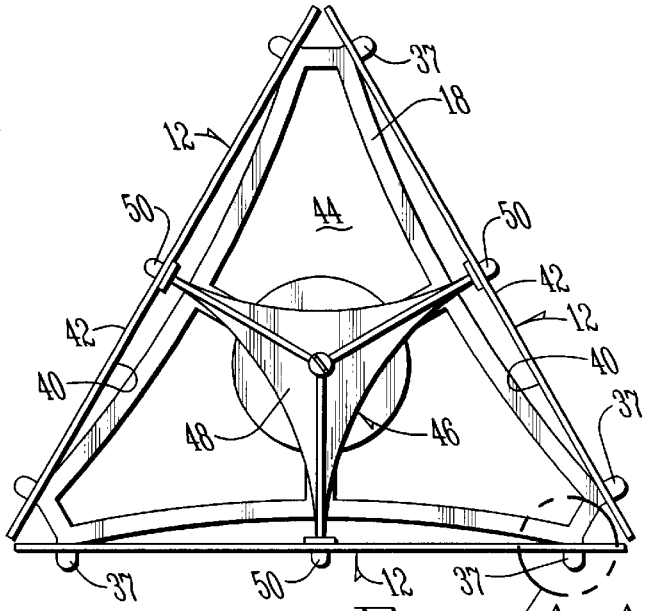
FIG. 2 is a top plan view of the support for the card display.
Figure 3:
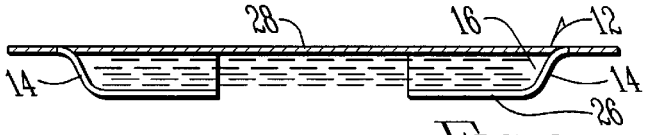
FIG. 3 is a cross-sectional view taken along line 3—3 of FIG. 1 showing the greeting cards retained in the pocket of the apparatus of the present invention.
Figure 4:
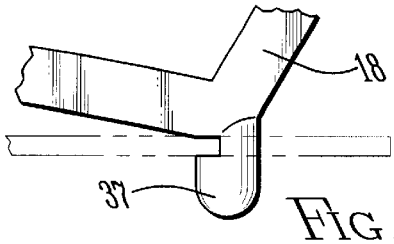
FIG. 4 is a cross sectional view taken along line 4—4 of FIG. 2 showing a nodule of the support of the present invention with a portion of the vertical panel cut-away for clarity.
Figure 6:
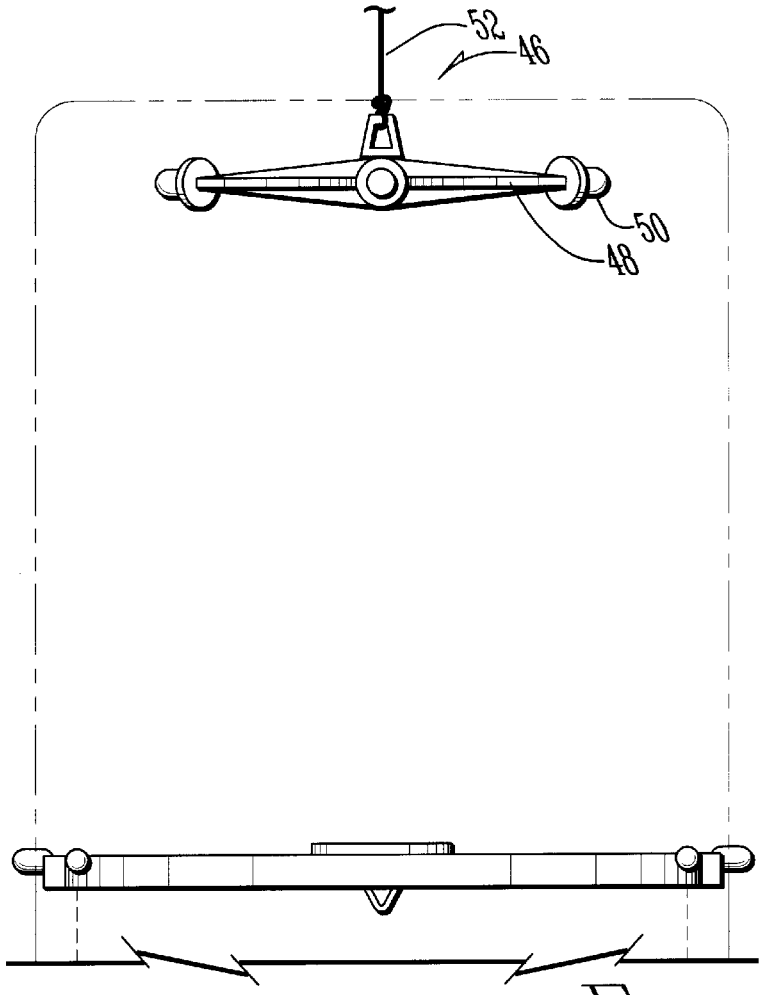
FIG. 6 is a partial side elevational view with the vertical panels of the present invention cut-away to display the support structure of the present invention.

As shown in FIG. 2, the support 18 of the present invention is formed to support each of the plurality of vertical panels. The greeting card display apparatus preferably includes a support 18 for the upper end 34 of the plurality of vertical panels and a support for the lower end 36 of vertical panels. For each vertical panel, each support 18 includes a pair of nodules 37 that are operatively configured to be coupled with an aperture 38 formed in each vertical panel such that the plurality of vertical panels are interconnected the same support. Preferably, and as shown in FIGS. 1 and 6, the nodules are configured to be mateable with the relief 30 formed in the upper end of each slit. As such, the nodules protrude frontwise of each panel and provide a guide for the greeting cards as the cards are inserted into the pockets 16 defined by slits 14 and brace the cards as held in the pocket 16 to maintain a substantially vertical alignment.

In the preferred embodiment in which the card display includes three vertical panels, the support 18 includes three pairs of two nodules 37. Preferably, the support 18 is formed in the shape of an equilateral triangle and each leg of the triangle includes a pair of nodules protruding outwardly. The nodules are spaced on each face of the triangularly shaped support such that they are mateable with the relief apertures 30 of the upper ends of the uppermost and lowermost pair of slits 14. As shown in FIG. 2, each vertical panel 12 has an inner side 40 and an outer side 42, the inner side of each vertical panel faces inwardly as mounted to the support 18 and defines an inner region 44. The supports are positioned in the inner region of the apparatus. It is to be understood that the support can have different configurations and still be within the scope of the present invention.

The greeting card display 10 further includes a mount 46 such that the device can display the greeting cards effectively. In one embodiment shown in FIG. 1, the mount 46 includes a mounting structure 48 that has nodules 50 mateable with an aperture centrally located at the upper end of each vertical panel. For each vertical panel, the mounting structure includes one nodule. The mount further includes a cord 52 or other hanging device that permits the advertising display to be suspended from a ceiling or other overhang. Thus, as shown in FIG. 6, the mounting structure has three nodules that are received in an aperture of each vertical panel and has a cable 52 or string that suspends the display 10 at a desired location.

Figure 7:
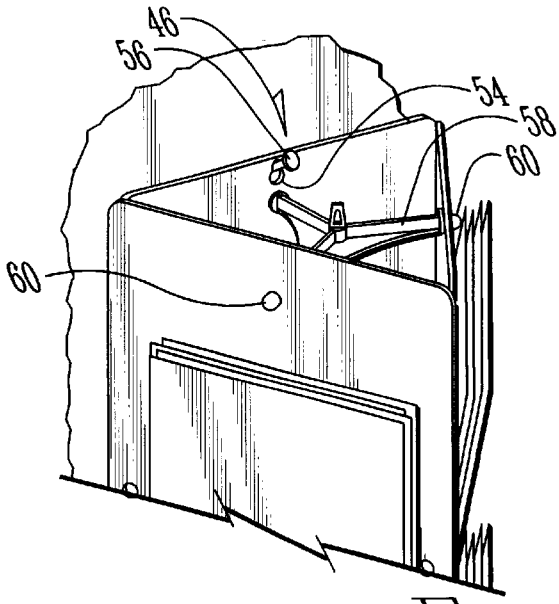
FIG. 7 is a perspective view showing an alternative mounting arrangement for the display of the present invention.

In an alternative embodiment of the mount, shown in FIG. 7, the mount 46 for the card display includes an aperture 54 formed in one of the vertical panels at an uppermost end and preferably the lowermost end of the vertical panel. This card display is then mounted to a vertical surface through a nail or other mounting means 56 extending from the vertical surface (such as a wall or an end of shelving) through the mounting apertures. Preferably, in this embodiment, the support 18 for the greeting card display further includes a top support 58 for containing the uppermost end of the vertical panels. As shown in FIG. 7, this top support 58 includes nodules 60 mateable with an aperture centrally located at the upper end of each vertical panel. For each vertical panel, the mounting structure includes one nodule.

In an alternative embodiment of the card display apparatus of the present invention, the apparatus comprises a single vertical panels 12 having a plurality of pairs of opposed slits 14 defining pockets 16 for holding cards and a mount for mounting the panel to a substantially vertical surface. The panel 12 is constructed of a thin, sturdy synthetic resin sheet having pairs of slits disposed vertically in several rows for insertably holding a card, and particularly a greeting card. Preferably, the sheet is made transparent to enable the cards to be distinguished as to the kinds and the patterns of the cards as they are housed in the card-display apparatus. The slits are constructed in like manner as the previous embodiment such that each slit 14 has a top end 20 and a bottom end 22 and each pair of slits are spaced from each other at the top ends of the respective slits by a distance somewhat larger than the width of the card. The slits 14 further extend from the top end 20 to the bottom end 22 and each include an inward step 24 to approach the other preferably at approximately the midportion of the slit. It is to be understood that the slit 14 could slant inwardly toward each other from the top end to the bottom end, without departing from the scope of the present invention.

In this alternative embodiment, each pair of slits 14 define a pocket 16 having a card supporting portion 26 at the inward step 24 and a base 28 at the interior angle side of the slits 14, whereby the card inserted from above into the slits is held at both sides in a sandwiching manner in the pocket 16 between the base of the vertical panel and the card-supporting portion. In order to facilitate the acceptance of the cards and permit the insertion of multiple cards, the top and bottom ends 20, 22, respectively, of each slit 14 is formed with a relief 30. As shown in FIG. 1, the relief is preferably formed as an aperture, which permits the card-supporting portions of each slit to move frontwise of the display apparatus. The aperture 30 may be sized to accommodate a particular number of cards.

The vertical interval between the upper end and the lower end of each slit for each pair of slits is preferably set smaller than the longitudinal length of the card. As such, when the card is inserted into a pair of slits 14 until the card abuts at a lower edge 32 of the pair of slits, the upper edge of the card projects upwardly from the upper end 20 of each pair of slits. This enables the card to be easily viewed and slipped in or out of the card display apparatus 10.

The vertical interval between respective pairs of slits 14 is set such that a standard size card slightly overlap the pair of slits immediately above the pair of slits in which the card is mounted. This provides for a particularly aesthetically pleasing display enabling a plurality of cards to be arranged vertically in an orderly fashion.

Although several embodiments have been described, they are merely exemplary of the invention and not to be construed as limiting, the invention being defined solely by the appended claims.

What is claimed is:

1. An apparatus for holding and displaying cards, the apparatus comprising:

three vertical panels, at least two of the vertical panels having at least one pair of opposed slits defining a pocket therebetween for holding and accepting several cards, each slit of the at least one pair of opposed slits having an upper end, a lower end and an aperture disposed at each of said upper end and lower end, said apertures being operatively configured to allow the pocket to expand to thereby accept a greater number of cards than the pocket could accept if no apertures were present; and at least one support having a nodule for each vertical panel, each nodule being operatively configured to be coupled with at least one aperture of each vertical panel such that the plurality of vertical panels are interconnected by the at least one support;

wherein each of the vertical panels has an inner side and an outer side, the inner side of each vertical panel facing inwardly as mounted to the at least one support and defining an inner region, the at least one support being positioned in the inner region of the apparatus, and wherein the at least one support has six nodules, the nodules being coupled to the apertures at the upper end of at least one pair of slits on each of the vertical panels.

2. An apparatus for holding and displaying cards, the apparatus comprising:

three vertical panels, at least two of the vertical panels having at least one pair of opposed slits defining a pocket therebetween for holding and accepting several cards, each slit of the at least one pair of opposed slits having an upper end, a lower end and an aperture disposed at each of said upper end and lower end, said apertures being operatively configured to allow the pocket to expand to thereby accept a greater number of cards than the pocket could accept if no apertures were present; and at least one support having a nodule for each vertical panel, each nodule protruding outwardly from an inner region when the vertical panels are mounted to the at least one support, and each nodule being operatively configured to be coupled with at least one aperture of each vertical panel such that the plurality of vertical panels are interconnected by the at least one support;

wherein each of the vertical panels has an inner side and an outer side, the inner side of each vertical panel facing inwardly as mounted to the at least one support and defining the inner region, the at least one support being positioned in the inner region of the apparatus, and wherein the at least one support has six nodules, the nodules being coupled to the apertures at the upper end of at least one pair of slits on each of the vertical panels.

3. A card-display apparatus adapted to hold and display cards and capable of being mounted to a substantially vertical surface, the apparatus comprising at least one substantially vertical panel having at least two pair of opposed, substantially vertical slits, each pair of slits defining a pocket therebetween for holding the cards and including an inward step defining a card supporting portion, each slit of the at least two pair of slits having an upper end, a lower end and an aperture disposed at each of said upper end and said lower end of each slit, said apertures being operatively configured to allow the pocket to expand to thereby enable the respective pocket to accept a greater number of cards, and to allow the card supporting portion to move frontwise of the remainder of the vertical panel to thereby enable the pair of slits to accept several cards.

* * * * *